US010145271B2

(12) United States Patent
Brown et al.

(10) Patent No.: US 10,145,271 B2
(45) Date of Patent: Dec. 4, 2018

(54) MASS-EFFICIENT ROCKING COMPONENT

(71) Applicant: GM Global Technology Operations LLC, Detroit, MI (US)

(72) Inventors: Tyson W. Brown, Royal Oak, MI (US); Anil K. Sachdev, Rochester Hills, MI (US); Michael B. Fleck, Royal Oak, MI (US); Ronald B. Beals, South Lyon, MI (US); Kevin M. Luchansky, Sterling Heights, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 148 days.

(21) Appl. No.: 15/421,795

(22) Filed: Feb. 1, 2017

(65) Prior Publication Data

US 2018/0216501 A1 Aug. 2, 2018

(51) Int. Cl.
*F01L 1/18* (2006.01)
*F01L 1/46* (2006.01)

(52) U.S. Cl.
CPC ..... *F01L 1/181* (2013.01); *F01L 1/46* (2013.01); *F01L 2101/00* (2013.01); *F01L 2103/00* (2013.01); *F01L 2810/02* (2013.01)

(58) Field of Classification Search
CPC . F01L 1/181; F01L 1/2422; F01L 1/46; F01L 2101/00; F01L 2103/00; F01L 2810/02
USPC ..... 123/90.36, 90.39
See application file for complete search history.

(56) References Cited

U.S. PATENT DOCUMENTS 4,440,121 A * 4/1984 Clancy ..... F01L 1/183 123/90.39
4,589,383 A * 5/1986 Showalter ..... F01L 1/12 123/90.36
4,674,453 A * 6/1987 Dove, Jr. ..... F01L 1/183 123/90.39
4,784,095 A * 11/1988 Golding ..... F01L 1/183 123/90.33
4,944,257 A * 7/1990 Mills ..... F01L 1/182 123/90.39
5,048,368 A 9/1991 Mrdjenovich et al.
5,060,606 A * 10/1991 Hubbard ..... F01L 1/183 123/90.39
5,063,889 A * 11/1991 Pryba ..... F01L 1/182 123/90.33
5,370,093 A 12/1994 Hayes
6,227,156 B1 * 5/2001 Autrey ..... F01L 1/18 123/90.33

(Continued)

*Primary Examiner* — Jorge Leon, Jr.
(74) *Attorney, Agent, or Firm* — Harness, Dickey & Pierce, P.L.C.

(57) ABSTRACT

A monolithic rocker arm component includes a first lateral wall defining a first aperture and a first mass reducing feature, an opposing second wall defining a second aperture and a second mass reducing feature, a pushrod receiving member that bridges the first lateral wall and the second lateral wall at a first end of the rocker arm, and a tongue element that bridges the first lateral wall and the second lateral wall at a second end of the rocker arm. The pushrod receiving member routes oil from the first towards the second end. The monolithic rocker arm may have one or more internal regions having lattice structures. Methods for additive manufacturing the monolithic rocker component are also provided.

19 Claims, 5 Drawing Sheets

(56) References Cited

U.S. PATENT DOCUMENTS

| | | | | |
|---|---|---|---|---|
| 2002/0096013 | A1* | 7/2002 | Cutshall | F01L 1/18 74/559 |
| 2005/0014060 | A1 | 1/2005 | Suzuki | |
| 2006/0283287 | A1 | 12/2006 | Pankl | |
| 2007/0044745 | A1* | 3/2007 | Smith | F01L 1/181 123/90.41 |
| 2009/0000579 | A1* | 1/2009 | Rozario | F01L 1/146 123/90.1 |
| 2016/0061067 | A1* | 3/2016 | Schultheis | F01L 13/0036 123/90.16 |
| 2017/0136697 | A1 | 5/2017 | Kia et al. | |
| 2017/0136698 | A1 | 5/2017 | Kia et al. | |
| 2017/0211168 | A1 | 7/2017 | Liu et al. | |
| 2017/0363040 | A1 | 12/2017 | Brown et al. | |
| 2018/0045082 | A1* | 2/2018 | Foster | F01L 13/0005 |
| 2018/0200835 | A1 | 7/2018 | Chae et al. | |
| 2018/0216658 | A1 | 8/2018 | Brown et al. | |

* cited by examiner

MASS-EFFICIENT ROCKING COMPONENT

INTRODUCTION

This section provides background information related to the present disclosure which is not necessarily prior art.

Internal combustion engines include intake valves that open to introduce air into a cylinder and exhaust valves that open to provide an exit path out of the cylinder for exhaust gases. Intake and exhaust valves may have valve stems that communicate with rocker arms. Rocker arms are levers that are actuated directly by a rotating cam or indirectly by a rotating cam by way of a pushrod. When a cam or pushrod raises one end of a rocker arm, the rocker arm pivots such that an opposing end pushes downward on a valve stem, thus opening a valve. Thus rocker arms change a direction of the cam's lifting force and provide mechanical advantage during valve lifting.

Because rocker arms continuously open and close valves during the operation of vehicles, ideally rocker arms are durable and have as low a moment of inertia as possible to enhance efficiency. Reducing weight of rocker arms can further enhance efficiency. Accordingly, there is a need to develop new rocker arms that meet these characteristics.

SUMMARY

This section provides a general summary of the disclosure, and is not a comprehensive disclosure of its full scope or all of its features.

The present disclosure relates to a rocking or rocker component. The rocker component may include a monolithic body. The monolithic body includes a first end and an opposing second end. The monolithic body also includes a first lateral wall that extends from the first end to the opposing second end. The first lateral wall defines a first aperture and a first mass reducing feature. A second lateral wall extends from the first end to the second end. The second lateral wall defines a second aperture and a second mass reducing feature. The first aperture and the second aperture are aligned and configured to receive a cylindrical rocker bearing. The monolithic body includes a pushrod receiving member that bridges the first lateral wall and the second lateral wall at the first end. The pushrod receiving member defines a first surface and a second surface. The pushrod receiving member includes an oil receiving aperture extending through the pushrod receiving member from the first surface to the second surface. The first surface defines a contour configured to receive a pushrod and the second surface has a substantially vertical first portion extending upward from the second surface and a second portion extending over the oil receiving aperture. The second portion defines an angle θ with respect to the first portion of greater than 0° to less than or equal to about 90°. A tongue element bridges the first lateral wall and the second lateral wall at the second end. The tongue element including a third surface configured to receive a valve stem. The rocker component is configured such that oil is introduced upward through the oil receiving aperture, deflected off of the second portion of the second surface of the pushrod receiving member, and directed toward the second end such that it flows along at least one surface of the tongue element.

In certain aspects, the tongue element has a tongue portion with a cross-section geometry of an I-beam. A lower horizontal portion of the I-beam defines a J-channel. The rocker component is configured such that oil is introduced upward through the oil receiving aperture, deflected off of the second portion of the second surface of the pushrod receiving member, and directed toward the second end such that it flows along the J-channel.

In certain aspects, the first lateral wall and the second lateral wall are only connected via the pushrod receiving member and the tongue element to define a central void region.

In certain aspects, the first and second lateral walls are substantially free of any gating structures.

In certain aspects, the rocker component is made by additive manufacturing and includes at least one region having a lattice structure.

In certain aspects, the at least one region corresponds to an interior portion of the tongue element that includes the lattice structure.

In certain aspects, the angle θ is greater than or equal to about 20° to less than or equal to about 70°.

In other aspects, the angle θ is greater than or equal to about 40° to less than or equal to about 50°.

In certain aspects, the first surface of the pushrod receiving member having the contour and the third surface of the tongue element include a protective coating disposed thereon.

In certain aspects, the protective coating includes a material selected from the group consisting of: hydrogenated-diamond like carbon, non-hydrogenated-diamond like carbon, tungsten carbide, molybdenum disulfide, graphite, polytetrafluoroethylene, a thermosetting polymer, a metal oxide, and combinations thereof.

In certain aspects, the monolithic body includes a material selected from the group consisting of steel alloy, stainless steel alloy, titanium alloy, aluminum alloy, chrome-cobalt alloys, iron-aluminum-silicon intermetallics, high entropy alloys, metal-dominant materials, metal matrix composites, carbon fiber composites, composite materials comprising a polymer and a reinforcement material, and combinations thereof.

In certain aspects, the rocker component defines a pivot axis passing transversely through the first and second apertures and a center of mass is less than or equal to about 10 mm from the center of the pivot axis.

In certain aspects, the rocker component has a mass of less than or equal to about 80 grams.

In certain aspects, the rocker component is formed via additive manufacturing and has a mass reduction of greater than or equal to about 10% as compared to a cast rocker component.

In certain aspects, an interior portion of at least one of the first lateral wall, the second lateral wall, the pushrod receiving member, and the tongue element is hollow, such that a moment of inertia of the rocker component is minimized.

In other aspects, a method of manufacturing a rocker component is provided. The method optionally includes additive manufacturing a monolithic body from a powder metal precursor. The monolithic body includes a first end and an opposing second end. The monolithic body also includes a first lateral wall that extends from the first end to the opposing second end. The first lateral wall defines a first aperture and a first mass reducing feature. A second lateral wall extends from the first end to the second end. The second lateral wall defines a second aperture and a second mass reducing feature. The first aperture and the second aperture are aligned and configured to receive a cylindrical rocker bearing. The monolithic body includes a pushrod receiving member that bridges the first lateral wall and the second lateral wall at the first end. The pushrod receiving member defines a first surface and a second surface. The pushrod receiving member includes an oil receiving aperture extending through the pushrod receiving member from the first surface to the second surface. The first surface defines a contour configured to receive a pushrod and the second surface has a substantially vertical first portion extending upward from the second surface and a second portion extending over the oil receiving aperture. The second portion defines an angle θ with respect to the first portion of greater than 0° to less than or equal to about 90°. A tongue element bridges the first lateral wall and the second lateral wall at the second end. The tongue element including a third surface configured to receive a valve stem. The rocker component is configured such that oil is introduced upward through the oil receiving aperture, deflected off of the second portion of the second surface of the pushrod receiving member, and directed toward the second end such that it flows along at least one surface of the tongue element.

In certain aspects, the additive manufacturing is selected from the group consisting of: direct metal laser sintering, direct energy deposition, electron beam direct metal melting systems, blown powder directed energy deposition, wire-fed directed energy deposition, liquid metal three-dimensional (3D) printing system, and combinations thereof.

In certain aspects, the powder metal precursor includes a material selected from the group consisting of steel alloy, stainless steel alloy, titanium alloy, aluminum alloy, chrome-cobalt alloys, iron-aluminum-silicon intermetallics, high entropy alloys, metal-dominant materials, metal matrix composites, carbon fiber composites, composite materials comprising a polymer and a reinforcement material, and combinations thereof.

In certain aspects, an interior portion of at least one of the first lateral wall, the second lateral wall, the pushrod receiving member, and the tongue element includes a lattice structure.

In certain aspects, the method further includes applying a protective coating to at least one of the first surface of the pushrod receiving member having the contour and the third surface of the tongue element, where the applying is conducted by a process selected from the group consisting of: additive manufacturing, direct energy deposition (DED), chemical vapor deposition (CVD), chemical vapor infiltration, physical vapor deposition (PVD), atomic layer deposition (ALD), electron beam evaporation, laser arc evaporation, and combinations thereof. The protective coating includes a material selected from the group consisting of: hydrogenated-diamond like carbon, non-hydrogenated-diamond like carbon, tungsten carbide or other metal carbide, molybdenum disulfide, graphite, polytetrafluoroethylene, a thermosetting polymer, a hardened metal or metal oxide, and combinations thereof.

In certain aspects, the first lateral wall and the second lateral wall are only connected via the pushrod receiving member and the tongue element to define a central void region. The rocker component defines a pivot axis passing transversely through the first and second apertures and a center of mass is less than or equal to about 10 mm from the center of the pivot axis.

In certain aspects, the rocker component has a mass reduction of greater than or equal to about 10% as compared to a cast rocker component.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 1 is an investment cast rocker arm component;

FIGS. 2A-2C show a mass-efficient rocking component according to certain aspects of the present disclosure. FIG. 2A is an isometric view; FIG. 2B is a top view; FIG. 2C is a side view;

Corresponding reference numerals indicate corresponding parts throughout the several views of the drawings.

DETAILED DESCRIPTION

Figure 1:
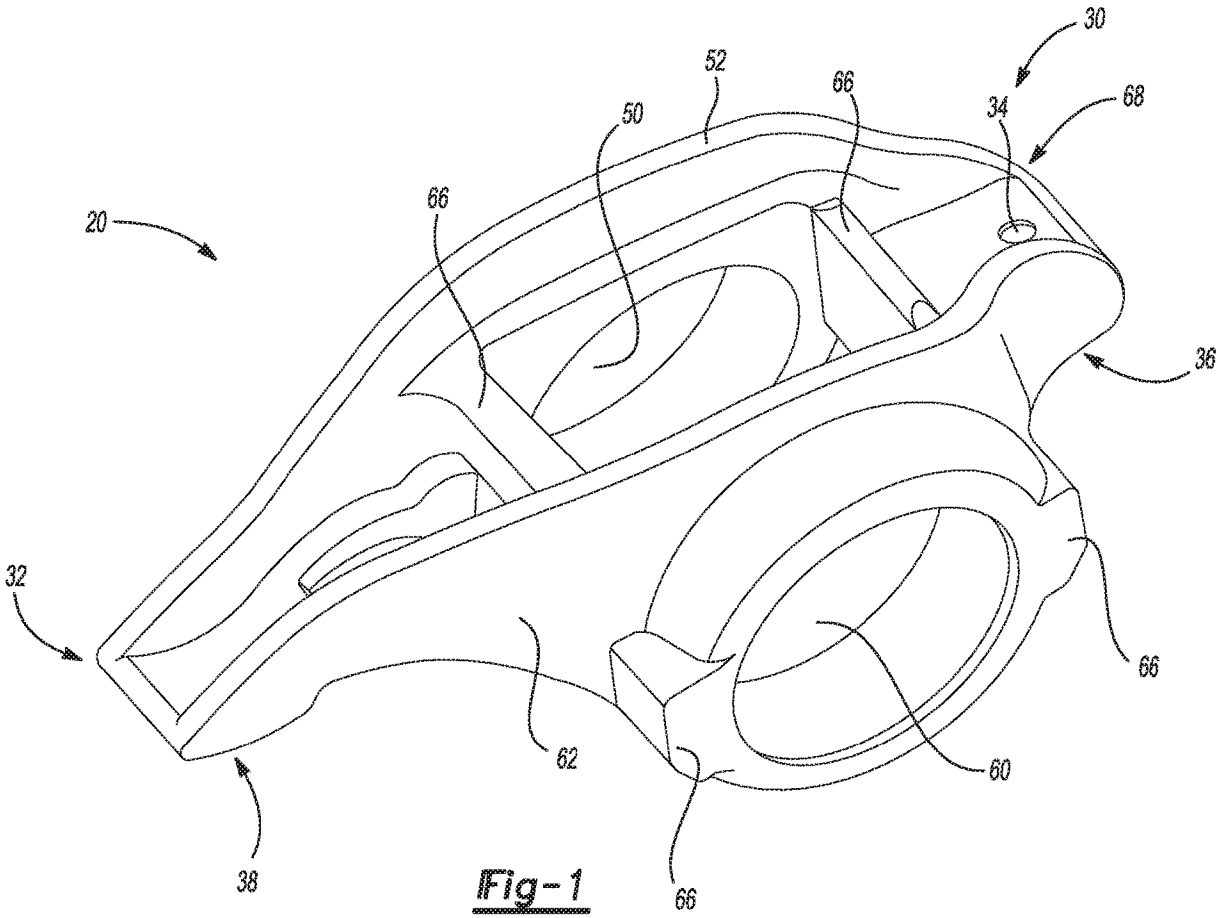

Example embodiments are provided so that this disclosure will be thorough, and will fully convey the scope to those who are skilled in the art. Numerous specific details are set forth such as examples of specific compositions, components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, elements, compositions, steps, integers, operations, and/or components, but do not preclude the presence or addition of one or more other features, integers, steps, operations, elements, components, and/or groups thereof. Although the open-ended term "comprising," is to be understood as a non-restrictive term used to describe and claim various embodiments set forth herein, in certain aspects, the term may alternatively be understood to instead be a more limiting and restrictive term, such as "consisting of" or "consisting essentially of." Thus, for any given embodiment reciting compositions, materials, components, elements, features, integers, operations, and/or process steps, the present disclosure also specifically includes embodiments consisting of, or consisting essentially of, such recited compositions, materials, components, elements, features, integers, operations, and/or process steps. In the case of "consisting of," the alternative embodiment excludes any additional compositions, materials, components, elements, features, integers, operations, and/or process steps, while in the case of "consisting essentially of," any additional compositions, materials, components, elements, features, integers, operations, and/or process steps that materially affect the basic and novel characteristics are excluded from such an embodiment, but any compositions, materials, components, elements, features, integers, operations, and/or process steps that do not materially affect the basic and novel characteristics can be included in the embodiment.

Any method steps, processes, and operations described herein are not to be construed as necessarily requiring their performance in the particular order discussed or illustrated, unless specifically identified as an order of performance. It is also to be understood that additional or alternative steps may be employed, unless otherwise indicated.

When a component, element, or layer is referred to as being "on," "engaged to," "connected to," or "coupled to" another element or layer, it may be directly on, engaged, connected or coupled to the other component, element, or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various steps, elements, components, regions, layers and/or sections, these steps, elements, components, regions, layers and/or sections should not be limited by these terms, unless otherwise indicated. These terms may be only used to distinguish one step, element, component, region, layer or section from another step, element, component, region, layer or section. Terms such as "first," "second," and other numerical terms when used herein do not imply a sequence or order unless clearly indicated by the context. Thus, a first step, element, component, region, layer or section discussed below could be termed a second step, element, component, region, layer or section without departing from the teachings of the example embodiments.

Spatially or temporally relative terms, such as "before," "after," "inner," "outer," "beneath," "below," "lower," "above," "upper," and the like, may be used herein for ease of description to describe one element or feature's relationship to another element(s) or feature(s) as illustrated in the figures. Spatially or temporally relative terms may be intended to encompass different orientations of the device or system in use or operation in addition to the orientation depicted in the figures.

Throughout this disclosure, the numerical values represent approximate measures or limits to ranges to encompass minor deviations from the given values and embodiments having about the value mentioned as well as those having exactly the value mentioned. Other than in the working examples provided at the end of the detailed description, all numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. For example, "about" may comprise a variation of less than or equal to 5%, optionally less than or equal to 4%, optionally less than or equal to 3%, optionally less than or equal to 2%, optionally less than or equal to 1%, optionally less than or equal to 0.5%, and in certain aspects, optionally less than or equal to 0.1%.

In addition, disclosure of ranges includes disclosure of all values and further divided ranges within the entire range, including endpoints and sub-ranges given for the ranges.

Example embodiments will now be described more fully with reference to the accompanying drawings.

In various aspects, the present disclosure provides rocker arms or rocking components (referred to herein as a rocker arm component) for use in internal combustion engines and methods of manufacturing such rocker arm components. The rocker arm components provided by certain aspects of the present disclosure may have new designs that are lightweight and have reduced mass, are durable, and enable improved location of a center of mass and moment of inertia to increase efficiency. Such rocker arm components may be formed via an additive manufacturing process. Additive manufacturing is a process by which a solid three-dimensional structure is built layer-by-layer, typically via a printing deposition process or where energy or heat is selectively applied to powder or wire starting materials to solidify, fuse, or sinter and create a layer of solid material. Additive manufacturing is often referred to synonymously with three-dimensional printing, as will be described below. Additive manufacturing permits implementation of a variety of new designs.

By way of background, FIG. 1 shows a cast metal rocker arm 20, which may be made by investment casting, by way of non-limiting example. The cast metal rocker arm 20 defines a first end 30 and an opposite second end 32. The first end 30 has an aperture 34 through which oil may pass. On a first side 36, the first end 30 is configured to receive and be coupled to a pushrod (not shown) that is attached to a cam shaft. The second end 32 is considered to be a tongue region and has a first side 38 that is configured to receive and be attached to a valve stem (not shown) that lifts and lowers an inlet/outlet valve (not shown) for a cylinder in the internal combustion engine. As the cam shaft rotates, the rocker arm 20 connected thereto via the push rod at the first end 30 serves as a lever that intermittently lifts and lowers the valve stem connected to the second end 32.

The rocker arm 20 also includes a first aperture 50 on a first lateral wall 52 and a second aperture 60 on a second lateral wall 62. The first aperture 50 and the second aperture 60 may respectively be centrally disposed on each lateral wall. The first aperture 50 and the second aperture 60 are aligned with one another and are configured to receive a cylindrical rocker bearing (not shown) that rotates therein. The first lateral wall 52 and the second lateral wall 62 are connected to one another at the first end 30, the second end 32, and via one or more gating structures 66 (e.g., central truss members) formed during the casting process. Additional gating structures are also formed as part of the structures that surround the first aperture 50 and the second aperture 60. It should be noted that the gating structures 66 are required during casting to ensure that molten liquid passes throughout all regions of the mold cavity. However, such gating structures 66 add mass to the rocker arm 20 component without serving a structural function during operation.

During operation of the rocker arm 20, oil passes from the first side 36 of aperture 34 on the first end 30 and sprays upwards towards a second side 68. However, flow of lubricant oil is not specifically directed or controlled near the rocker arm 20. Ideally, lubricant oil would be directed towards the other wear surfaces, such as near the first and second apertures 50, 60 that receive the rotating rocker bearing and towards the first side 38 of the tongue region/second end 32. However, in cast components like rocker arm 20 shown, such oil delivery is non-directional. Improved oil delivery can serve to enhance efficiency of performance and a lifetime of the rocker arm components.

In various aspects, the present disclosure provides rocker arm components and methods of manufacturing rocking components via additive manufacturing processes. As noted above, additive manufacturing is a process by which a solid three-dimensional structure is built layer-by-layer, typically via a printing deposition process or where energy or heat is selectively applied to powder starting materials to solidify, fuse, or sinter and create a layer of solid material. Thus, additive manufacturing can form a unitary or monolithic sintered metallic body from a powder metal precursor. Non-limiting examples of additive manufacturing processes include fused deposition modeling and selective laser sintering, including direct metal laser sintering, direct energy deposition, electron beam direct metal melting systems, blown powder directed energy deposition, wire-fed directed energy deposition, and liquid metal 3D printing system with "MagnetJet" technology with metals.

A digital three dimensional modeling system can be used to create a digital model of the structure to be formed. The physical structure can then be formed from the digital model by an additive manufacturing system. The system may include scanners that survey a structure's surface and develops a three-dimensional map of the structure's surface geometry. Laser or energy can be directed at a powder precursor in a pattern to sinter the materials and form a fused structure. The fused monolithic structure can be built layer-by-layer.

The power metal precursors may be materials that contain iron, aluminum, magnesium, titanium, and the like. For example, the powder metal precursor optionally comprises a material selected from the group consisting of steel, stainless steel, titanium alloy, aluminum alloys, chrome-cobalt alloys, iron-aluminum-silicon intermetallics, high entropy alloys, similar metal-dominant materials, metal matrix composites, composite materials comprising a polymer matrix and one or more reinforcement materials (such as carbon fibers, glass, and the like), including carbon fiber composites, and combinations thereof. Steel generally comprises iron and carbon, while stainless steel further comprises chromium and/or nickel, as well as additional optional alloying ingredients. Representative high strength steel alloys include American Iron and Steel Institute (AISI) 4140 that is a low alloy steel including chromium, molybdenum, manganese, and carbon or AISI 8620 that is an alloy steel including manganese, nickel, chromium, and carbon, inter alia. Additive manufacturing enables higher flexibility as compared to casting during manufacturing and thus provides new designs with various advantageous features, as will be described herein.

Figure 2A:
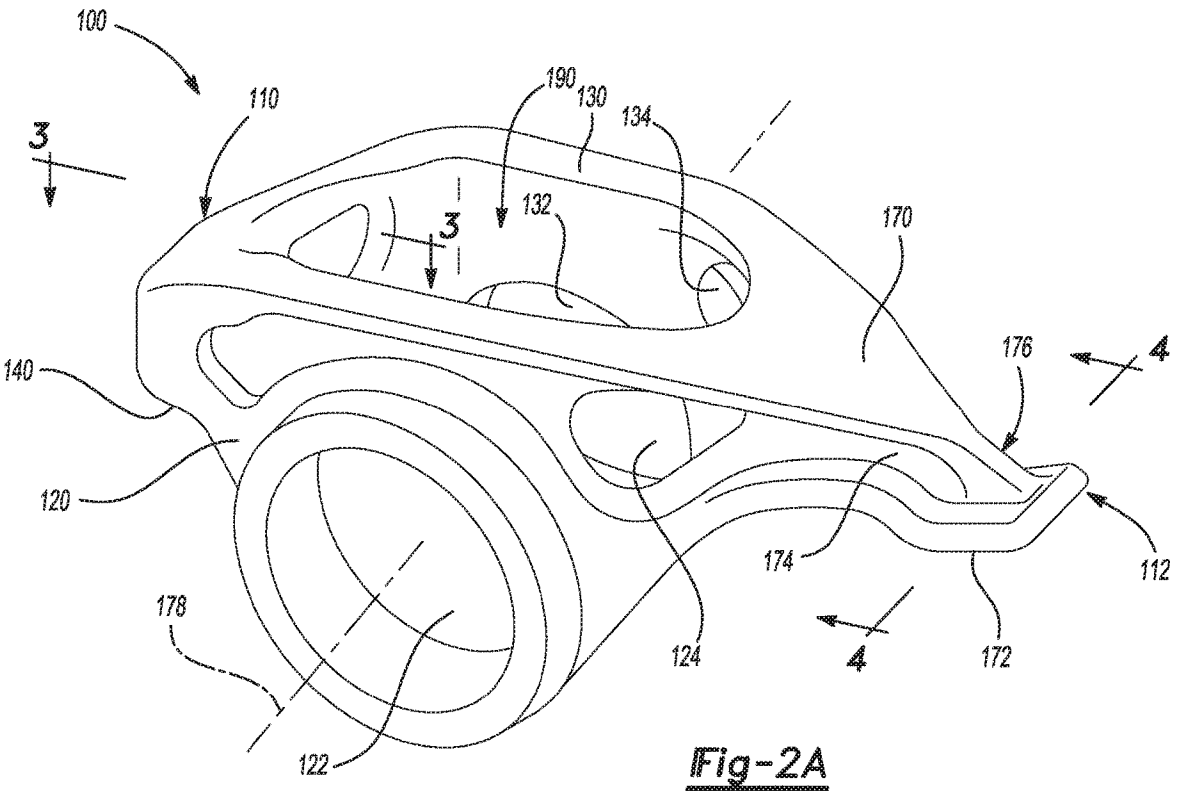
Figure 2B:
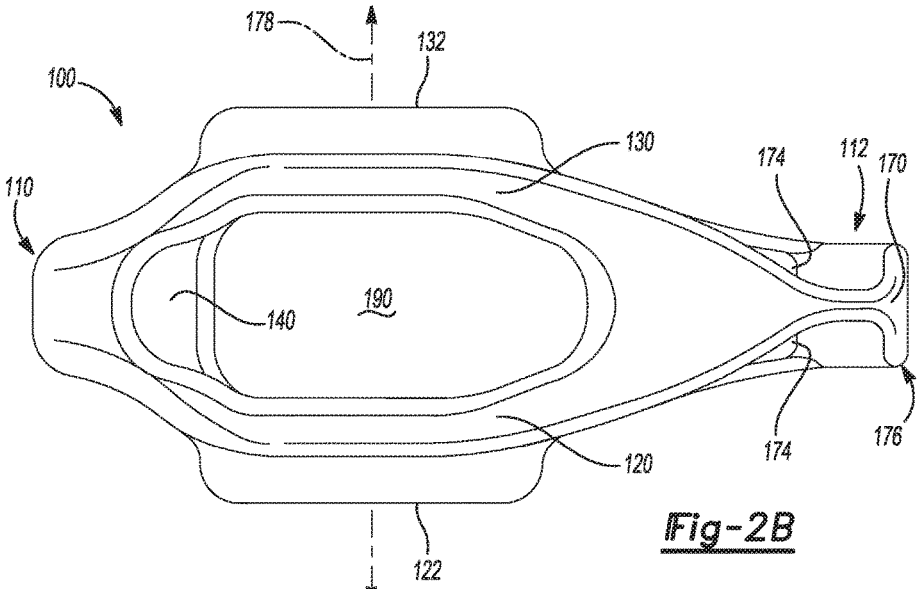
Figure 2C:
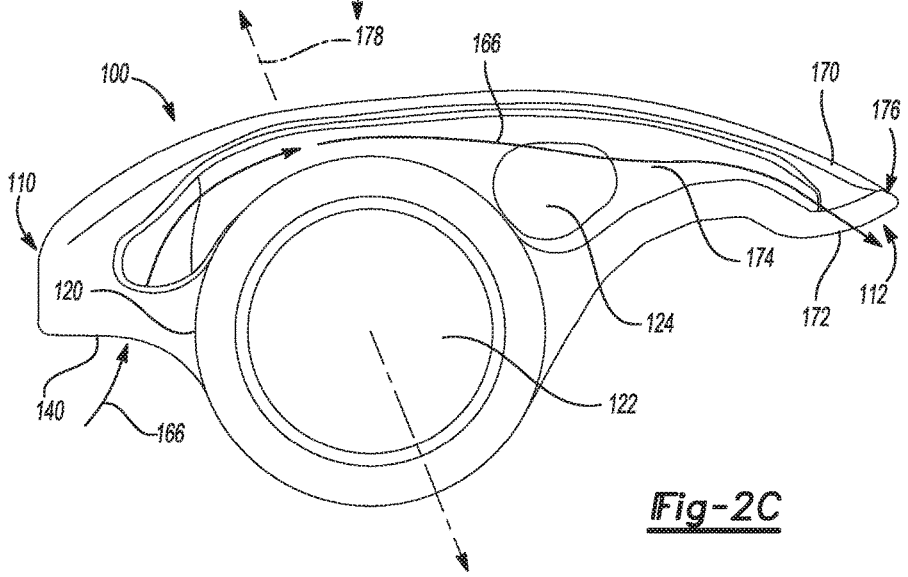

In one aspect, the present disclosure contemplates a rocker arm component having a monolithic body. The component may be an integrally formed, as a single piece or unitary structure, for example, a monolithic structure. FIGS. 2A-2C show a rocker arm 100 prepared according to certain aspects of the present disclosure. The rocker arm 100 has a first end 110 and an opposing second end 112. A first lateral wall 120 extends from the first end 110 to the opposing second end 112. The first lateral wall 120 defines both a first aperture 122 and at least one first mass-reducing feature 124 in the form of an opening. A second lateral wall 130 also extends from the first end 110 to the opposing second end 112. The second lateral wall 130 defines both a second aperture 132 and at least one second mass-reducing opening 134. The first aperture 122 and the second aperture 132 are aligned with one another and configured to receive and/or interact with a cylindrical rocker bearing (not shown).

Figure 3:
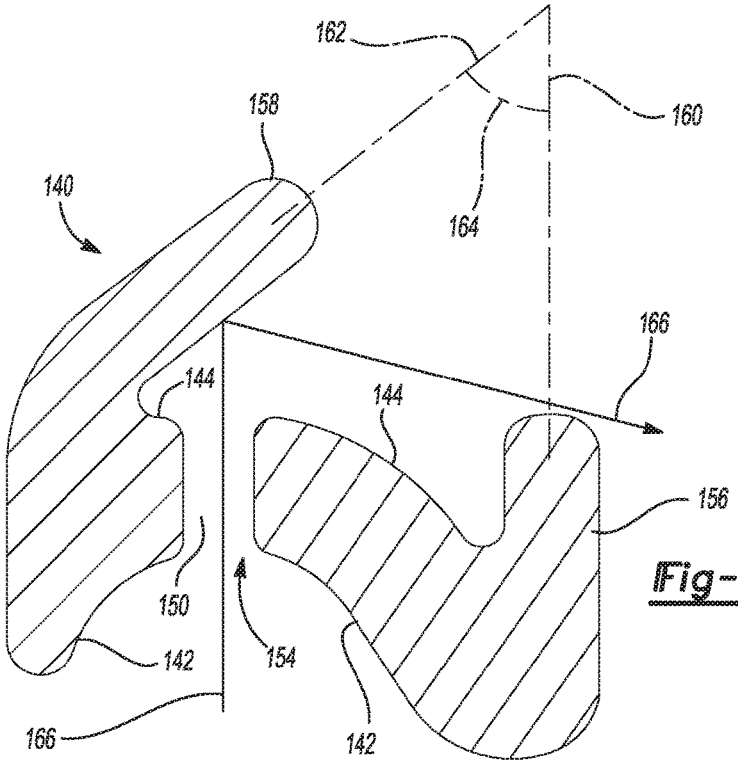
FIG. 3 shows a cross sectional view of the rocking component according to certain aspects of the present disclosure of FIG. 2A taken along line 3-3 of FIG. 2A.

At the first end 110, a pushrod receiving member 140 is formed. The pushrod receiving member 140 connects and bridges the first lateral wall 120 and the second lateral wall 130 at the first end 110. As best seen in FIG. 3, the pushrod receiving member 140 defines a first surface 142 and a second surface 144. An oil receiving aperture 150 extends through the pushrod receiving member 140 from the first surface 142 to the second surface 144. The first surface 142 defines a contoured region 154 configured to receive and/or interact with a pushrod (not shown). The second surface 144 defines a substantially vertical first portion 156 extending upward from the second surface 144. The second surface 144 also defines a protruding second portion 158. It should be noted that in alternative variations, the first portion 156 may have other orientations aside from vertical. The second portion 158 extends over at least a portion of the oil receiving aperture 150. A first axis 160 extends through the first portion 156 and a second axis 162 extends through the second portion. 158. An angle (θ) 164 is defined between the first axis 160 and the second axis 162. Thus, the second portion 158 defines an angle θ (164) with respect to the first portion 156 of greater than 0° to less than or equal to about 90°, optionally greater than or equal to about 20° to less than or equal to about 70°, and in certain aspects, optionally greater than or equal to about 40° to less than or equal to about 50°. A flow of lubricant oil as would occur during operation is designated by a fluid flow path 166. Thus, as oil enters the aperture 150, its path is deflected by the second portion 158 extending out over the aperture 150. The oil thus flows towards the first portion 156 and a central area of the rocker arm 100. It should be noted that the ability to form the pushrod receiving member 140 having such a design is only possible due to additive manufacturing techniques and was not previously possible with metal casting processes.

With renewed reference to FIGS. 2A-2C, a tongue element 170 connects or bridges the first lateral wall 120 and the second lateral wall 130 at the second end 112. The tongue element 170 comprises a third surface 172 configured to receive and/or interact with a valve stem (not shown). One or more fluid flow features 174 are also formed in the tongue element 170 that ends in a terminal region 176

As best seen in FIGS. 2C and 3, the rocker arm 100 is thus designed so that lubricant oil follows fluid flow path 166, wherein it is introduced upward through the oil receiving aperture 150 in the pushrod receiving member 140, deflected off of the second portion 158 of the second surface 144 of the pushrod receiving member, and directed toward the terminal region 176 of the second end 112. In certain variations, the oil flows along at least one fluid flow feature 174 of the tongue element 170 towards the terminal region 176.

In certain aspects, the terminal region 176 of the tongue element 170 may have a terminal tongue portion with a cross-sectional geometry of an I-beam 180 as shown in FIG.

4. The I-beam 180 includes an upper horizontal portion 182, a lower horizontal portion 184, and a connecting portion 186. Each terminal region of the lower horizontal portion 184 further includes a lip 188. In this manner, the lower horizontal portion 184 of the I-beam 180 defines a J-channel. Oil flow is thus improved along such a J-channel configuration in the tongue element 170. In such a variation, the rocker arm 100 is configured such that oil is introduced upward through the oil receiving aperture 150 in the pushrod receiving member 140, deflected off of the second portion 158 of the second surface 144 of the pushrod receiving member, and directed toward the second end 112, where it flows along at least one fluid flow feature 174 of the tongue element 170 and then along the J-channel defined by the lower horizontal portion 184 and lips 188 in the I-beam 180.

In certain aspects, the first lateral wall 120 and the second lateral wall 130 are only connected via the pushrod receiving member 140 and the tongue element 170 to define a central open or void region 190 (best seen in FIGS. 2A and 2B). Thus, the first and second lateral walls 120, 130 are free of any gating structures (like gating structure 66 shown in FIG. 1) that are necessarily present when a conventional casting process is used to form a rocker arm component to ensure adequate molten metal flow within the casting cavity. Such a design reduces an overall weight of the component. In certain aspects, an interior portion of at least one of the first lateral wall, the second lateral wall, the pushrod receiving member, and the tongue element may be hollow or contain a lattice structure, such that overall mass of the rocker arm, as well as a moment of inertia of the rocker arm are minimized.

The rocker arm 100 defines a pivot axis 178 shown passing transversely through the first aperture 122 and second aperture 132 and corresponding to a longitudinal axis of the rocker bearing. The rocker arm 100 pivots around the pivot axis 178 during operation while rocking back and forth from the first end 110 to the second end 112, thus, the pivot axis 178 represents a rotational axis of the rocker arm 100. The closer a center of mass of the rocker component is to a central pivot point or pivot axis, the more efficient the performance of the rocker component. Likewise, the lower the moment of inertia is relative to a pivot axis, the more efficient the performance of the rocker arm. In accordance with certain aspects of the present disclosure, the present disclosure contemplates designs where a center of mass and a moment of inertia are more closely aligned to the pivot axis to enable more efficient performance. In one variation, a center of mass of the rocker arm is less than or equal to about 10 mm from the center of the pivot axis, optionally less than or equal to about 9 mm, optionally less than or equal to about 8 mm, optionally less than or equal to about 7 mm, optionally less than or equal to about 6 mm, and in certain variations, optionally less than or equal to about 5 mm.

As discussed above, in certain aspects, the rocker arm is made by additive manufacturing. Components made by additive manufacturing are not only lightweight, but may have complex shapes and also high strength and stiffness. Thus, the rocker arm 100 formed from additive manufacturing can have one or more mass reducing features formed in the body structure. It should be noted that the mass-reducing feature may be an opening or hole, an enclosed void or empty internal region, or an internal region having a lattice structure. Generally, a lattice structure includes a plurality of cell units that form a repeating structure. The lattice structure includes one or more open or void regions, where solid structures are absent. The void regions may be surrounded by a solid material web. The void regions may occupy a substantial volume of the cell. Thus, the lattice structure may result in a significant reduction in volume and weight when compared to an entirely solid structure, such as a cast metal component.

The density of the respective units within the lattice structure may be varied throughout to create regions of greater levels of strength corresponding to higher density as compared to regions of lower density with relatively less strength. Areas of the rocking component that experience relatively higher stress include the lower horizontal portion 184 and vertical member 186 of the tongue element 170, by way of non-limiting example. Thus, a higher density lattice structure may be provided in the above regions.

In certain variations, density of the lattice structure may be varied by increasing or decreasing the volume of the void regions. Thus, a region of a rocking component that experiences higher stresses may have a relatively low volume of voids and a relatively high volume of material.

In certain other variations, the volume occupied by the voids of the lattice structure may be relatively uniform throughout the lattice structure. Higher strength regions may be created by use of two materials, a first lower strength material in the low stress regions and a second higher strength material in the high stress regions.

Rocking components having lattice structures as described above can be formed by additive manufacturing techniques. Indeed, additive manufacturing is particularly suitable for forming rocking components having complex geometries. Thus, rocking components formed by additive manufacturing can have highly complex and freeform shapes. For example, geometries can include curvature, internal voids or hollow regions, channels, passages, and holes. Furthermore, properties such as density (void space), weight, strength, stiffness, deflection levels, and material can be varied throughout the rocking component.

Certain non-limiting advantages of rocking arms incorporating lattice regions are that they can be designed to have a high strength and a relatively low mass compared to cast rocking components. Rocker arms formed via additive manufacturing can be an integrally formed, single piece, unitary monolithic structure.

For example, the rocker arm 100 made by additive manufacturing defines at least one first mass-reducing feature 124 and at least one second mass-reducing opening 134 to improve mass efficiency. In certain aspects, the rocker arm component may be formed of a metal and have a total mass of less than or equal to about 85 grams, optionally less than or equal to about 80 grams, optionally less than or equal to about 75 grams, and in certain variations, optionally less than or equal to about 70 grams. The ability to form the mass-reducing features is possible due to additive manufacturing techniques. In certain variations, a mass of a metallic rocker arm prepared in accordance with certain aspects of the present disclosure weighs greater than or equal to about 8 grams less than a cast metallic rocker arm, optionally greater than or equal to about 10 grams, optionally greater than or equal to about 12 grams, and in certain variations, greater than or equal to about 15 grams less than a cast metallic rocker arm. In certain variations, a mass of a metallic rocker arm prepared in accordance with certain aspects of the present disclosure has a reduction in mass of greater than or equal to about 8% as compared to a cast metallic rocker arm, optionally greater than or equal to about 9% reduction in mass, optionally greater than or equal to about 10% reduction in mass, optionally greater than or equal to about 11% reduction in mass, optionally greater than or equal to about 12% reduction in mass, optionally greater than or equal to about 13% reduction in mass, optionally greater than or equal to about 14% reduction in mass, and in certain variations, optionally greater than or equal to about 15% reduction in mass.

Figure 4:
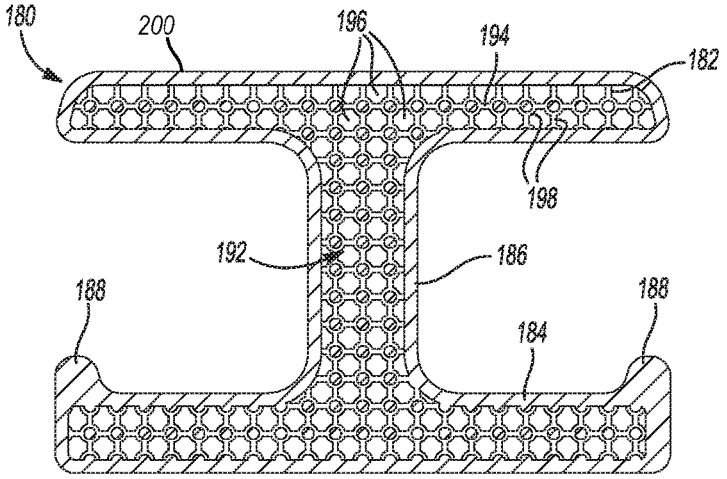
FIG. 4 shows a cross sectional view of a terminal region of a tongue element of the rocking component according to certain aspects of the present disclosure of FIG. 2A taken at line 4-4 of FIG. 2A.

In certain aspects, the rocker arm 100 is made by additive manufacturing and further comprises at least one region having a lattice structure. In one variation, the at least one region having a lattice structure corresponds to an interior portion of the tongue element 170. As shown in FIG. 4, an interior portion 192 of an I-beam 180 of tongue element 170 has a lattice structure 194 formed therein. The lattice structure 194 may include a plurality of hollow or open regions 196 defined between interconnected solid structures 198. The lattice structure 194 serves to reduce a bulk weight as compared to a solid region, thus serving to further reduce weight of the component. An external solid surface 200 seals the lattice structure 194 in the interior region 192 from the external environment during operation. While not shown, a temporary opening may be formed in the external surface 200 of the tongue element 170 (or any other region of the rocker arm component having an internal lattice structure) to remove excess loose powder remaining in the open regions 196 after the additive manufacturing process is completed. After removal of loose powder, the temporary opening may then be closed to form a continuous sealed external surface 200. In certain other alternative variations, an internal region within the rocker arm may merely define a void or open space with no lattice structure therein, depending on the structural and performance requirements of the region of the rocker arm.

Figure 5:
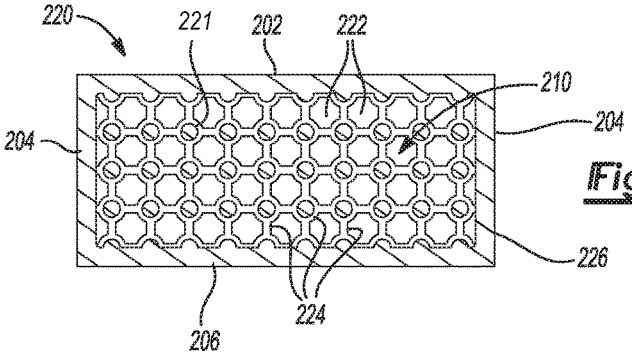
FIG. 5 shows a cross-sectional view of an alternative embodiment of a terminal region of a tongue element of the rocking component rocking component according to certain aspects of the present disclosure.

FIG. 5 shows an alternative variation of a cross-sectional geometry of a terminal region 220 of a tongue element. In this variation, the terminal region 220 has a rectangular cross-section defining a top wall 202, two side walls 204, and a bottom wall 206. Other cross-sectional shapes, including other rectilinear shapes, are also contemplated for the terminal region of the tongue element. It should be noted that while not shown in FIG. 5, the tongue element itself may still define one or more fluid flow features (like fluid flow features 174 formed in the tongue element 170 in FIGS. 2C and 3) to direct oil to flow towards terminal region 220.

In one variation, an interior region 210 of the tongue element defines a lattice structure 221. The lattice structure 221 may include a plurality of hollow or open regions 222 defined between interconnected solid structures 224. An external solid surface 226 seals the lattice structure 221 in the interior region 210 from the external environment during operation. While not shown, a temporary opening may be formed in the external surface 226 of the terminal region 220 of the tongue element (or any other region of the rocker arm component having an internal lattice structure) to remove excess loose powder remaining in the open regions 222 after the additive manufacturing process is completed. After removal of loose powder, the temporary opening may then be closed to form a continuous sealed external surface 226.

In other aspects, the present disclosure provides a rocker arm component having one or more surface regions with a protective layer or coating formed thereon. The protective coating may be formed on a wear surface of the rocker arm component and may provide wear resistance and/or enhance strength at the wear surface. In certain variations, the protective coating comprises a material selected from the group consisting of: diamond-like carbon, including hydrogenated and non-hydrogenated diamond-like carbon, tungsten carbide or other metal carbide, molybdenum disulfide, graphite, polytetrafluoroethylene, a thermosetting polymer, a hardened metal or metal oxide, and combinations thereof. The protective coating may be applied to at least one region on the surface of the rocker arm component by a process selected from the group consisting of: additive manufacturing, direct energy deposition (DED), chemical vapor deposition (CVD), chemical vapor infiltration, physical vapor deposition (PVD), atomic layer deposition (ALD), electron beam evaporation, laser arc evaporation, and combinations thereof. In other aspects, where the material comprises a polymer or composite material, it may be applied via spin coating, doctor blading, and the like.

Figure 6:
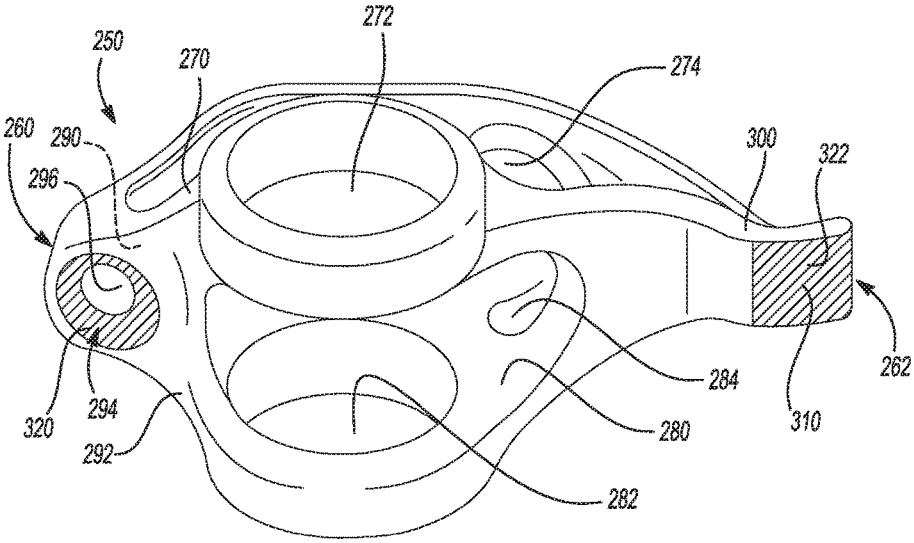
FIG. 6 shows a bottom perspective view of a rocking component according to certain aspects of the present disclosure having select regions coated with a protective wear-resistant coating.

FIG. 6 shows a bottom view of a rocker arm 250 having a protective coating selectively disposed thereon prepared according to certain variations of the present disclosure. The rocker arm 250 may define a first end 260 and an opposing second end 262. A first lateral wall 270 extends from the first end 260 to the opposing second end 262. The first lateral wall 270 defines both a first aperture 272 and at least one first mass-reducing opening 274. A second lateral wall 280 also extends from the first end 260 to the opposing second end 262. The second lateral wall 280 defines both a second aperture 282 and at least one second mass-reducing opening 284.

At the first end 260, a pushrod receiving member 290 is formed. The pushrod receiving member 290 connects and bridges the first lateral wall 270 and the second lateral wall 280 at the first end 260. The pushrod receiving member 290 defines a first surface 292. The first surface 292 defines a contoured region 294 configured to receive and/or interact with a pushrod (not shown). An oil receiving aperture 296 may be formed in the pushrod receiving member 290.

A tongue element 300 connects or bridges the first lateral wall 270 and the second lateral wall 280 at the second end 262. The tongue element 300 defines a second surface 310 configured to receive and/or interact with a valve stem (not shown). A first region 320 of the first surface 292 may have a protective coating formed thereon. Likewise, a second region 322 on the second surface 310 may have a protective coating formed thereon. Such protective coatings may provide localized wear resistance and/or higher strength in a predetermined region. Notably, the composition of the protective coating in the first region 320 and the second region 322 may be the same or may differ from one another, as the properties required in the different regions may differ from one another.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A rocker component comprising:

a monolithic body comprising:

a first end;

an opposing second end;

a first lateral wall extending from the first end to the opposing second end, the first lateral wall defining a first aperture and a first mass reducing feature;

a second lateral wall extending from the first end to the second end, the second lateral wall defining a second aperture and a second mass reducing feature;

a pushrod receiving member bridging the first lateral wall and the second lateral wall at the first end, wherein the pushrod receiving member defines a first surface and a second surface, the pushrod receiving member comprising:

an oil receiving aperture extending through the pushrod receiving member from the first surface to the second surface, wherein the first surface defines a contour configured to receive a pushrod and the second surface has a substantially vertical first portion extending upward from the second surface and a second portion extending over the oil receiving aperture, the second portion defining an angle θ with respect to the first portion of greater than 0° to less than or equal to about 90°; and a tongue element bridging the first lateral wall and the second lateral wall at the second end, the tongue element comprising a third surface configured to receive a valve stem, wherein the first aperture and the second aperture are aligned and configured to receive a cylindrical rocker bearing, and wherein the tongue element has a tongue portion with a cross-section geometry of an I-beam, wherein a lower horizontal portion of the I-beam defines a J-channel, and the rocker component is configured such that the oil is introduced upward through the oil receiving aperture, deflected off of the second portion of the second surface of the pushrod receiving member, and directed toward the second end such that the oil flows along the J-channel.

2. The rocker component of claim 1, wherein the first lateral wall and the second lateral wall are only connected via the pushrod receiving member and the tongue element to define a central void region.

3. The rocker component of claim 1, wherein the first lateral wall and the second lateral wall are substantially free of any gating structures.

4. The rocker component of claim 1, wherein the angle θ is greater than or equal to about 20° to less than or equal to about 70°.

5. The rocker component of claim 1, wherein the angle θ is greater than or equal to about 40° to less than or equal to about 50°.

6. The rocker component of claim 1, wherein the first surface of the pushrod receiving member having the contour and the third surface of the tongue element comprise a protective coating disposed thereon.

7. The rocker component of claim 6, wherein the protective coating comprises a material selected from a group consisting of: hydrogenated-diamond like carbon, non-hydrogenated-diamond like carbon, tungsten carbide or other metal carbide, molybdenum disulfide, graphite, polytetrafluoroethylene, a thermosetting polymer, a hardened metal or metal oxide, and combinations thereof.

8. The rocker component of claim 1, wherein the monolithic body comprises a material selected from a group consisting of steel alloy, stainless steel alloy, titanium alloy, aluminum alloy, chrome-cobalt alloys, iron-aluminum-silicon intermetallics, high entropy alloys, metal-dominant materials, metal matrix composites, composite materials comprising a polymer and a reinforcement material, carbon fiber composites, and combinations thereof.

9. The rocker component of claim 1, wherein the rocker component defines a pivot axis passing transversely through the first aperture and the second aperture, and a center of mass of the rocker component is less than or equal to about 10 mm from a center of the pivot axis.

10. A rocker component comprising:

a monolithic body comprising:

a first end;

an opposing second end;

a first lateral wall extending from the first end to the opposing second end, the first lateral wall defining a first aperture and a first mass reducing feature;

a second lateral wall extending from the first end to the second end, the second lateral wall defining a second aperture and a second mass reducing feature;

a pushrod receiving member bridging the first lateral wall and the second lateral wall at the first end, wherein the pushrod receiving member defines a first surface and a second surface, the pushrod receiving member comprising:

an oil receiving aperture extending through the pushrod receiving member from the first surface to the second surface, wherein the first surface defines a contour configured to receive a pushrod and the second surface has a substantially vertical first portion extending upward from the second surface and a second portion extending over the oil receiving aperture, the second portion defining an angle θ with respect to the first portion of greater than 0° to less than or equal to about 90°; and a tongue element bridging the first lateral wall and the second lateral wall at the second end, the tongue element comprising a third surface configured to receive a valve stem, wherein the first aperture and the second aperture are aligned and configured to receive a cylindrical rocker bearing and the rocker component is configured such that oil is introduced upward through the oil receiving aperture, deflected off of the second portion of the second surface of the pushrod receiving member, and directed toward the second end such that the oil flows along a fluid flow surface of the tongue element, wherein the tongue element has a tongue portion with a cross-section geometry of an I-beam, and wherein the rocker component is made by additive manufacturing and comprises at least one region having a lattice structure.

11. The rocker component of claim 10, wherein the at least one region corresponds to an interior portion of the tongue element, the inner portion of the tongue element comprising the lattice structure.

12. The rocker component of claim 10, wherein the rocker component is formed via additive manufacturing and has a mass reduction of greater than or equal to about 10% as compared to a cast rocker component.

13. The rocker component of claim 10, wherein an interior portion of at least one of the first lateral wall, the second lateral wall, the pushrod receiving member, and the tongue element is hollow.

14. A method of manufacturing a rocker component, the method comprising:

additive manufacturing a monolithic body, the monolithic body comprising:

a first end;

an opposing second end;

a first lateral wall extending from the first end to the opposing second end, the first lateral wall defining a first aperture and a first mass reducing feature;

a second lateral wall extending from the first end to the second end, the second lateral wall defining a second aperture and a second mass reducing feature;

a pushrod receiving member bridging the first lateral wall and the second lateral wall at the first end, wherein the pushrod receiving member defines a first surface and a second surface, the pushrod receiving member comprising:

an oil receiving aperture extending through the pushrod receiving member from the first surface to the second surface, wherein the first surface defines a contour configured to receive a pushrod and the second surface has a substantially vertical first portion extending upward from the second surface and a second portion extending over the oil receiving aperture, the second portion defining an angle θ with respect to the first portion of greater than 0° to less than or equal to about 90°; and a tongue element bridging the first lateral wall and the second lateral wall at the second end, the tongue element comprising a third surface configured to receive a valve stem, wherein the first aperture and the second aperture are aligned and configured to rotationally receive a cylindrical rocker bearing and the rocker component is configured such that oil is introduced upward through the oil receiving aperture, deflected off of the second portion of the second surface of the pushrod receiving member, and directed toward the second end such that the oil flows along a fluid flow surface of the tongue element.

15. The method according to claim 14, wherein the additive manufacturing is selected from a group consisting of: direct metal laser sintering, direct energy deposition, electron beam direct metal melting systems, blown powder directed energy deposition, wire-fed directed energy deposition, liquid metal three-dimensional (3D) printing system, and combinations thereof.

16. The method according to claim 14, wherein the powder metal precursor comprises a material selected from a group consisting of steel alloy, stainless steel alloy, titanium alloy, aluminum alloy, chrome-cobalt alloys, iron-aluminum-silicon intermetallics, high entropy alloys, metal-dominant materials, metal matrix composites, composite materials comprising a polymer and a reinforcement material, carbon fiber composites, and combinations thereof.

17. The method according to claim 14, wherein an interior portion of at least one of the first lateral wall, the second lateral wall, the pushrod receiving member, and the tongue element comprises a lattice structure.

18. The method according to claim 14, further comprising:

applying a protective coating to at least one of the first surface of the pushrod receiving member having the contour and the third surface of the tongue element, wherein:

the applying is conducted by a process selected from a group consisting of: additive manufacturing, direct energy deposition (DED), chemical vapor deposition (CVD), chemical vapor infiltration, physical vapor deposition (PVD), atomic layer deposition (ALD), electron beam evaporation, laser arc evaporation, and combinations thereof, and the protective coating comprises a material selected from a group consisting of: hydrogenated-diamond like carbon, non-hydrogenated-diamond like carbon, tungsten carbide or other metal carbide, molybdenum disulfide, graphite, polytetrafluoroethylene, a thermosetting polymer, a hardened metal or metal oxide, and combinations thereof.

19. The method according to claim 14, wherein the first lateral wall and the second lateral wall are only connected via the pushrod receiving member and the tongue element to define a central void region, and the rocker component defines a pivot axis passing transversely through the first aperture and the second aperture, and a center of mass of the rocker component is less than or equal to about 10 mm from a center of the pivot axis.

* * * * *